US010224673B2

(12) United States Patent
Sun et al.

(10) Patent No.: US 10,224,673 B2
(45) Date of Patent: Mar. 5, 2019

(54) HOLDER TO CONSTRAIN ELASTIC MEMBERS OF A RECEPTACLE

(71) Applicant: HEWLETT-PACKARD DEVELOPMENT COMPANY, L.P., Houston, TX (US)

(72) Inventors: Chia-Min Sun, Taipei (TW); Chung-Hung Huang, Taipei (TW); Pei-Yu Wang, Taipei (TW)

(73) Assignee: HEWLETT-PACKARD DEVELOPMENT COMPANY, L.P., Spring, TX (US)

( * ) Notice: Subject to any disclaimer, the term of this patent is extended or adjusted under 35 U.S.C. 154(b) by 0 days.

(21) Appl. No.: 15/557,941

(22) PCT Filed: May 21, 2015

(86) PCT No.: PCT/US2015/032015
§ 371 (c)(1),
(2) Date: Sep. 13, 2017

(87) PCT Pub. No.: WO2016/186677
PCT Pub. Date: Nov. 24, 2016

(65) Prior Publication Data

US 2018/0062313 A1 Mar. 1, 2018

(51) Int. Cl.

| | |
|---|---|
| ***H01R 13/639*** | (2006.01) |
| ***H01R 13/627*** | (2006.01) |
| *H01R 12/75* | (2011.01) |
| *H01R 12/71* | (2011.01) |

(52) U.S. Cl.
CPC ..... *H01R 13/639* (2013.01); *H01R 13/6271* (2013.01); *H01R 13/6275* (2013.01); *H01R 12/716* (2013.01); *H01R 12/75* (2013.01)

(58) Field of Classification Search
CPC . H01R 13/639; H01R 13/6271; H01R 12/716
USPC ..... 439/78, 660, 540.1, 541.5
See application file for complete search history.

(56) References Cited

U.S. PATENT DOCUMENTS 5,096,436 A * 3/1992 Noschese ..... H01R 13/6275 29/876
5,197,895 A * 3/1993 Stupecky ..... A61B 5/087 285/119
5,362,248 A * 11/1994 Hashiguchi ..... H01R 13/6271 439/350
6,508,678 B1 * 1/2003 Yang ..... H01R 13/64 439/607.08

(Continued)

FOREIGN PATENT DOCUMENTS

WO WO-2012/127704 A1 9/2012

*Primary Examiner* — Harshad C Patel
(74) *Attorney, Agent, or Firm* — HPI Patent Department

(57) ABSTRACT

Examples disclosed herein provide a system including a holder to secure a removable module. In one example, the removable module includes a plug comprising holes. The system further includes a receptacle mounted on a printed circuit board (PCB). As an example, the receptacle includes elastic members to make contact with the holes in the plug when the receptacle is to accommodate the plug of the removable module. As an example, the holder is slidable over the receptacle to constrain the elastic members of the receptacle to maintain contact with the holes in the plug of the removable module.

20 Claims, 6 Drawing Sheets

(56) References Cited

U.S. PATENT DOCUMENTS 6,655,979 B1 * 12/2003 Lee ..... H01R 13/6275 439/357
6,863,555 B2 * 3/2005 Ito ..... H01R 13/44 439/353
7,128,609 B1 * 10/2006 Chen ..... H01R 43/24 439/607.53
7,259,967 B2 8/2007 Ni et al.
7,322,845 B2 * 1/2008 Regnier ..... H01R 13/6275 439/352
7,473,124 B1 * 1/2009 Briant ..... H01R 13/6275 439/352
7,484,991 B1 2/2009 Kelaher et al.
7,556,514 B1 * 7/2009 Sorensson ..... H01R 13/703 200/51 R
7,872,873 B2 1/2011 Hiew et al.
8,029,306 B2 * 10/2011 Huang ..... H01R 13/633 439/352
8,179,669 B2 5/2012 Huang et al.
8,192,211 B1 6/2012 Huang et al.
8,231,400 B2 * 7/2012 Phillips ..... G02B 6/4201 439/357
8,308,376 B2 * 11/2012 Liao ..... G02B 6/3817 385/88
8,382,507 B2 * 2/2013 Yamaguchi ..... H01R 13/6275 439/346
8,465,304 B2 * 6/2013 Yen ..... H01R 13/4538 439/131
8,760,876 B2 6/2014 Huang et al.
9,088,087 B2 * 7/2015 Wardenburg ..... H01R 13/44
2004/0115990 A1 * 6/2004 Kodama ..... H01R 13/6271 439/607.24
2010/0151720 A1 6/2010 Lin
2011/0008986 A1 1/2011 Thom
2011/0256756 A1 10/2011 Lu et al.
2013/0217252 A1 8/2013 Carden
2014/0109181 A1 4/2014 Pomerantz et al.

* cited by examiner

HOLDER TO CONSTRAIN ELASTIC MEMBERS OF A RECEPTACLE

BACKGROUND

Computing devices, such as laptops or thin clients, may include removable modules or modular devices located internally within the computing devices. As an example, a receptacle for accommodating a modular device may be arranged on a printed circuit board (PCB), such as a motherboard of a computing device. As an example, an internal Universal Serial Bus (USB) device could be utilized in a computing device as a boot-up device, a storage, or an expandable usage.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

When a modular device is used by a computing device on a regular basis, it may not be desirable to connect the modular device to an external port on the computing device. For example, the modular device may occupy space around the computing device and interfere with operations of the computing device. In addition, the modular device that is externally connected may be inadvertently disconnected from the computing device while in use. As a result, it may be convenient to connect such modular devices internally within the computing devices.

Examples disclosed herein provide a holder that secures a modular device internally within a computing device while sustaining shock, vibration, and drop requirements. As computing devices, such as laptops or thin clients, are prone to vibration or being dropped by users, the holder may maintain the electrical connection between the modular device and the computing device by ensuring that the physical connection between the modular device and the computing device remains intact.

As will be further described, the holder may secure modular devices of various physical dimensions, not requiring the holder to be customized for each modular device that is connected internally within the computing device. As a result, modular devices may be easily swapped out without any concern on no longer meeting shock, vibration and drop requirements.

Figure 1A:
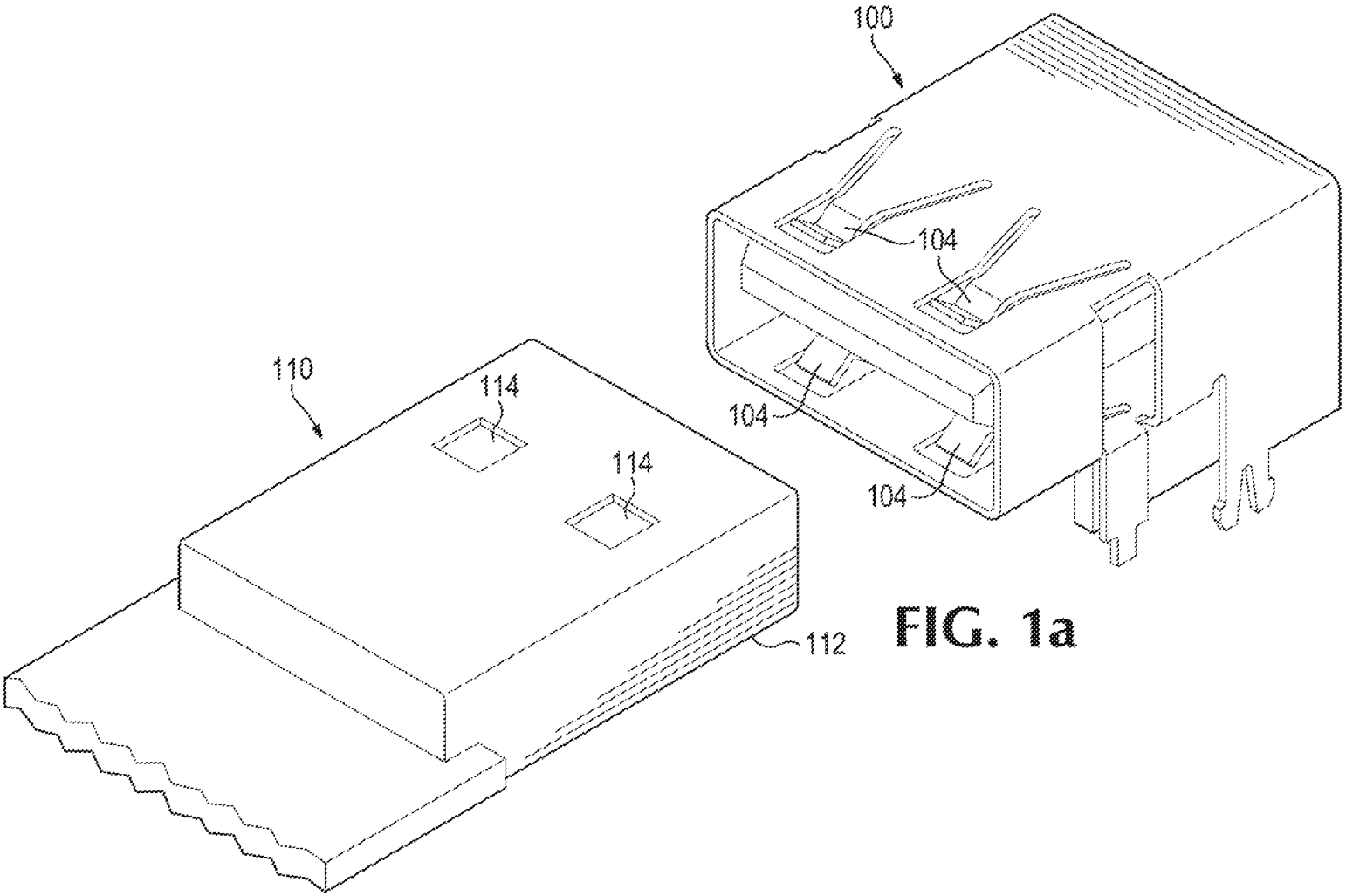
FIGS. 1*a-b* illustrate different views of a receptacle for accommodating a removable device or modular device, according to an example.
Figure 1B:
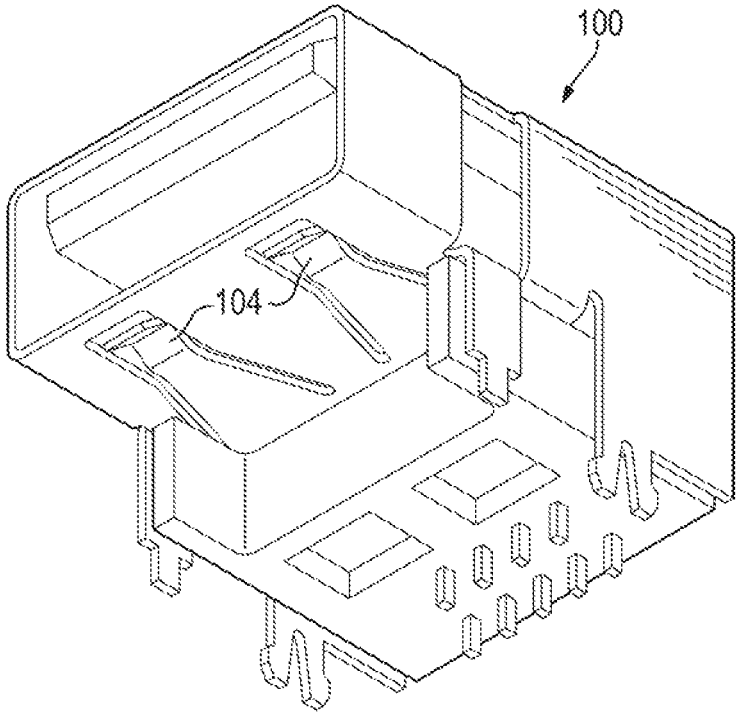

With reference to the figures, FIGS. 1*a-b* illustrate different views of a receptacle 100 for accommodating a removable device or modular device 110, according to an example. As mentioned above, the receptacle 100 may be mounted on and electrically coupled to a PCB within a computing device either via a socket or directly soldered to the PCB, for instance (e.g., see PCB 210 in FIG. 2*a*). The receptacle 100 and modular device 110 illustrated may correspond to a USB device. As mentioned above, an internal USB device could be utilized in a computing device as a boot-up device, a storage, or an expandable usage. Although the figures and the description describe features of a USB device, other platforms or connection types may be covered by the disclosure.

As illustrated, the modular device 110 includes a plug 112 for making a physical connection between the modular device 110 and the receptacle 100 in order to establish an electrical connection between the modular device 110 and the receptacle 100. As an example, the plug 112 of the modular device 110 includes a number of holes 114, and the receptacle 100 may include elastic members 104 to make contact with the holes 114 when the receptacle 100 is to accommodate the plug 112 of the modular device 110. As illustrated in FIGS. 1*a-b*, the receptacle 100 includes four elastic members 104 to make contact with a corresponding four holes 114 in the plug 112 of the modular device 110 (only two holes 114 illustrated). However, the number of elastic member 104 and holes 114 is not limited to what is illustrated.

When the elastic members 104 of the receptacle 100 are to make contact with the holes 114 in the plug 112 of the modular device 110, the elastic members 104 may provide a retaining force to secure the plug 112 within the receptacle 100 until an opposing force sufficient to overcome the retaining force is applied (e.g., a force that is sufficient to disconnect the modular device 110 from the receptacle 100). However, this retaining force may not be sufficient to sustain shock, vibration, and drop requirements, and may cause the modular device 110 to inadvertently drop out or disconnect from the receptacle 100.

Figure 2A:
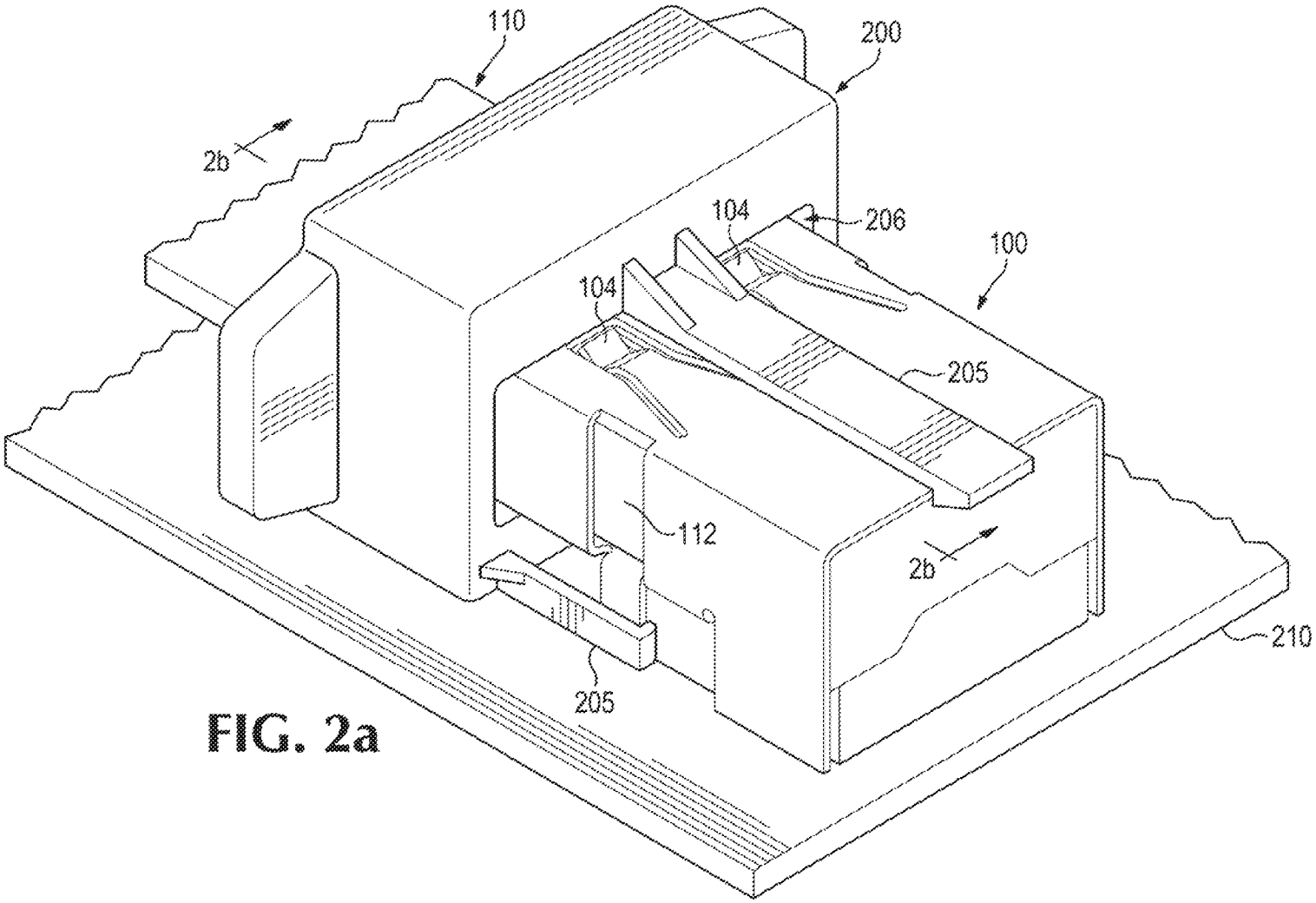
FIGS. 2*a-b* illustrate a system including a holder that is capable to secure the modular device to the receptacle while sustaining shock, vibration, and drop requirements, according to an example.
Figure 2B:
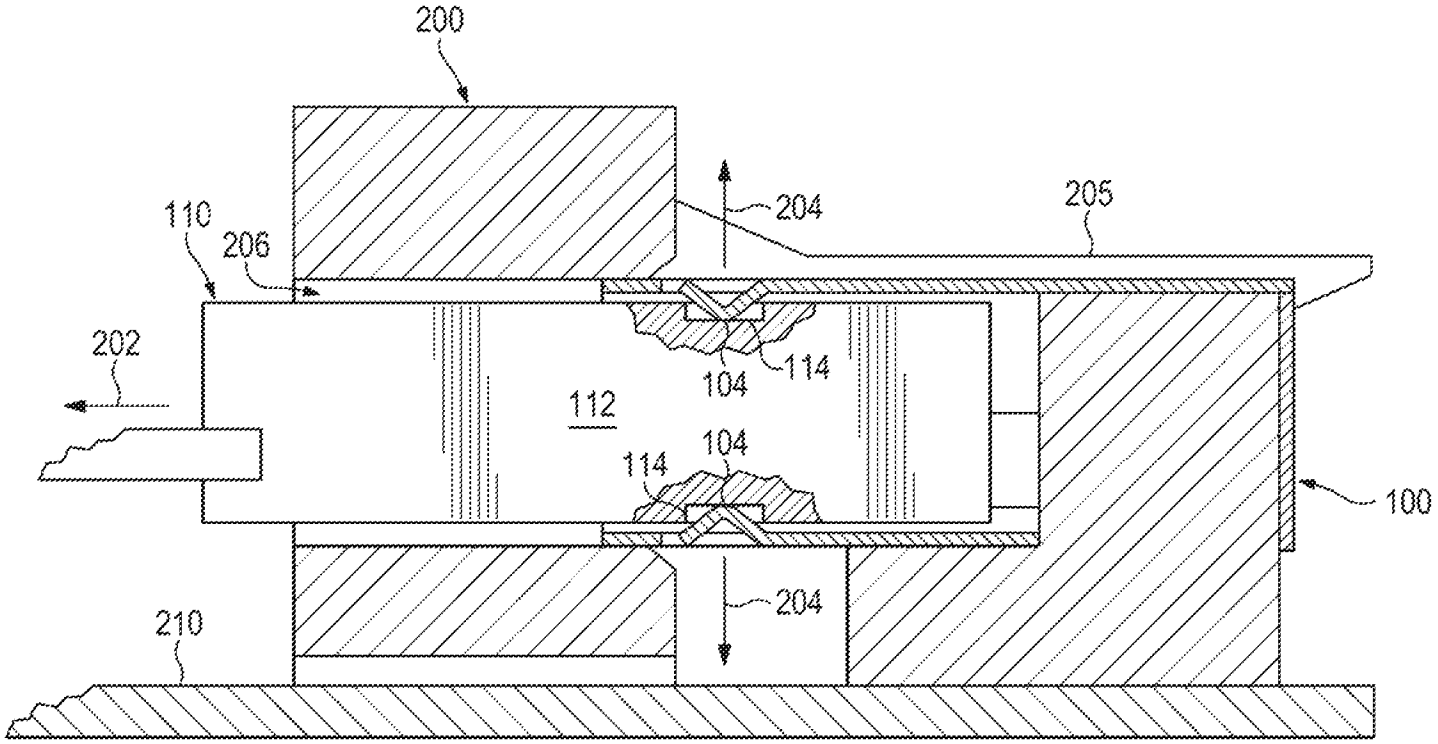

FIGS. 2*a-b* illustrate a system including a holder 200 that is capable to secure the modular device 110 to the receptacle 100 while sustaining shock, vibration, and drop requirements, according to an example. As will be further described, the holder 200 may be slidable over the receptacle 100 to constrain the elastic members 104 of the receptacle 100 to maintain contact with the holes 114 in the plug 112 of the modular device 110. By constraining the elastic members 104 or movement of the elastic members 104, the retaining force provided by the elastic members 104 may be sufficient to lock the plug 112 of the modular device 110 within the receptacle 100.

Referring to FIG. 2*a*, the holder 200 includes a hollow opening 206 to allow for the receptacle 100 to slide through the opening 206, according to an example. The holder 200 may include a number of tabs 205, for example, to limit the movement of the holder 200 with respect to the receptacle 100. For example, referring to the tab 205 on the side of the holder 200, the tab 205 may snap into a groove along the side of the receptacle 100, as illustrated, thereby restricting the movement of the holder 200 so that the tab 205 remains within the groove. Referring to the tab 205 on the top of the holder 200, the tab 205 may include a notch that prevents the holder 200 from sliding past a certain point along the receptacle 100, as illustrated. The use and number of the tabs 205 are not limited to what is illustrated or described.

FIG. 2*b* illustrates a cross section of the system illustrated in FIG. 2*a*, according to an example. As illustrated, the holder 200 is not disposed over the receptacle 100, or particularly the elastic members 104 of the receptacle 100. As a result, once a sufficient force 202 is applied in an attempt to remove the modular device 110 from the receptacle 100, the force 202 may overcome the retaining force provided by the elastic members 104, causing the elastic members 104 to move outwards from the holes 114, indicated by arrows 204, as the modular device 110 is pulled out. As described, when the holder 200 is not disposed over the elastic members 104 of the receptacle 100, the plug 112 of the modular device 110 is removable from the receptacle 100.

Figure 3A:
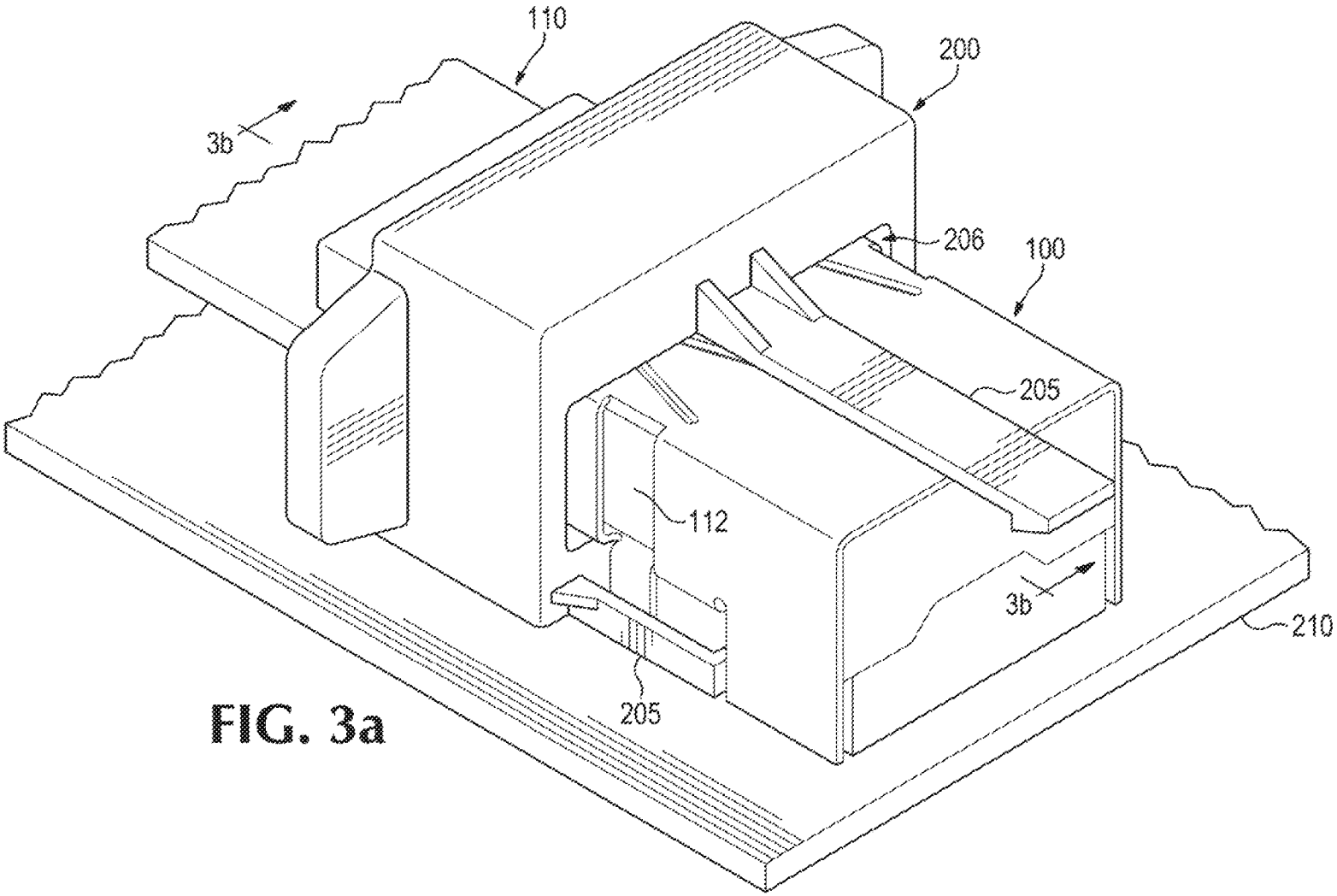
FIGS. 3*a-b* illustrate the system including the holder slid to surround elastic members of the receptacle, thereby constraining movement of the elastic members, according to an example.
Figure 3B:
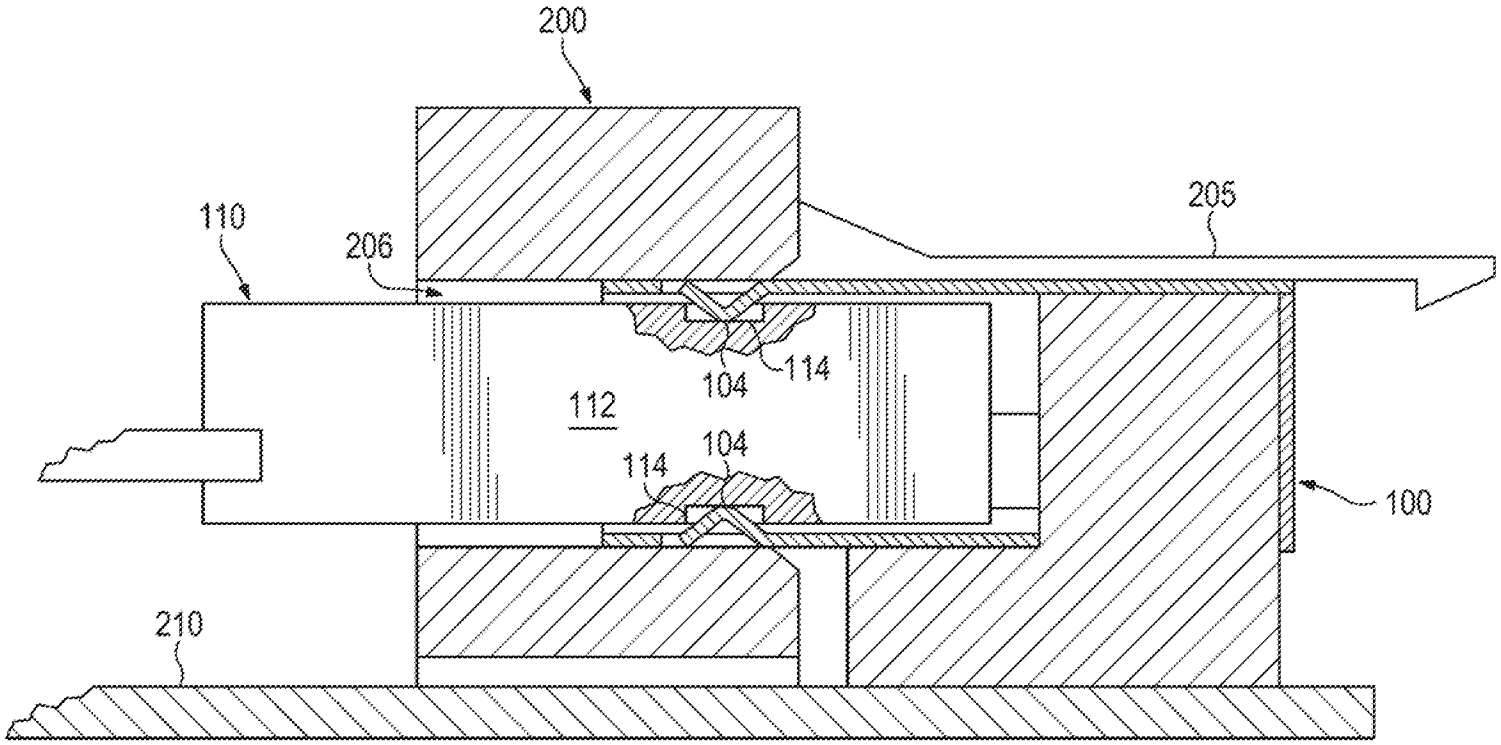

FIGS. 3*a-b* illustrate the system including the holder 200 slid to surround the elastic members 104 of the receptacle 100, thereby constraining movement of the elastic members 104, according to an example. By constraining the elastic members 104 or movement of the elastic members 104, the retaining force provided by the elastic members 104 may be sufficient to lock the plug 112 of the modular device 110 within the receptacle 100 and sustain any shock, vibration, and drop requirements. As described above, the tabs 205, particularly the tabs 205 on the sides of the holder 200, may restrict movement of the holder 200 until the tabs 205 reach one side of the groove along the side of the receptacle 100, according to an example.

FIG. 3*b* illustrates a cross section of the system illustrated in FIG. 3*a*, according to an example. As illustrated, the holder 200 is disposed over the elastic members 104 of the receptacle 100. As a result, although a significant amount of force may be applied in an attempt to remove the modular device 110 from the receptacle 100, as the holder 200 is disposed over the elastic members 104 any outward movement of the elastic members 104 may be restricted or prevented from occurring. Thereby, as the elastic members 104 remain within the holes 114 of the plug 112, the elastic members 104 may lock the plug 112 of the modular device 110 within the receptacle 100. As described, the holder 200 may maintain the electrical connection between the modular device 110 and the receptacle 100 of a computing device by ensuring that the physical connection between the modular device 110 and the receptacle 100 remains intact.

As described above, the holder 200 may secure modular devices of various physical dimensions, not requiring the holder 200 to be customized for each modular device that is connected internally within a computing device. For example, as the holder 200 sustains shock, vibration, and drop requirements by being slidable solely along the receptacle 100, various sizes of modular devices may be used and protected by the holder 200.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A system comprising:

a removable module comprising a plug, wherein the plug comprises holes disposed in an upper surface of the plug;

a receptacle mounted on a printed circuit board (PCB), wherein the receptacle comprises an upper surface, a stepped lower surface, a front end, and a back end, and elastic members formed on the upper surface and the stepped lower surface of the receptacle to make contact with the holes in the plug when the front end of the receptacle is to accommodate the plug of the removable module, and wherein the stepped lower surface of the receptacle is to engage the PCB; and a holder that is axially slidable over a longitudinal axis of the receptacle to constrain the elastic members of the receptacle to maintain contact with the holes in the plug of the removable module, wherein the holder surrounds four sides of the receptacle, wherein the holder comprises a hollow opening through an entire width of the holder to accommodate the receptacle, wherein the holder comprises a body portion completely surrounding the hollow opening, and wherein the body portion comprises a top surface, a bottom surface, and a pair of side surfaces all without holes.

2. The system of claim 1, wherein when the elastic members of the receptacle are to make contact with the holes in the plug of the removable module, the elastic members are to provide a retaining force to secure the plug within the receptacle until an opposing force sufficient to overcome the retaining force is applied.

3. The system of claim 2, wherein when the holder is slid to be disposed over the receptacle to constrain the elastic members of the receptacle, the retaining force provided by the elastic members is to lock the plug of the removable module within the receptacle.

4. The system of claim 3, wherein the holder is slidable to surround the elastic members of the receptacle to constrain movement of the elastic members.

5. The system of claim 1, wherein when the holder is not disposed over the elastic members of the receptacle, the plug of the removable module is removable from the receptacle.

6. The system of claim 1, wherein the holder comprises a plurality of tabs to limit movement of the holder with respect to the receptacle.

7. The system of claim 6, wherein the plurality of tabs comprises a pair of tabs snap into grooves along sides of the receptacle to restrict the movement of the holder so that the tabs remain within the grooves, and an elongated tab extending away from the receptacle and having a length extending past the back end of the receptacle to restrict a movement of the receptacle.

8. The system of claim 1, wherein the hollow opening is to allow the receptacle to slide through the hollow opening and along an axial direction of the hollow opening.

9. The system of claim 8, wherein the tabs extend away from the body portion opposite to the axial direction.

10. The system of claim 1, wherein the module and the receptacle are arranged to form a universal serial bus device.

11. A system comprising:

a removable module comprising a plug, wherein the plug comprises holes disposed in an upper surface of the plug;

a receptacle mounted on a printed circuit board (PCB), wherein the receptacle comprises an upper surface, a stepped lower surface, a front end, and a back end, and elastic members formed on the upper surface and the stepped lower surface of the receptacle to make contact with the holes in the plug when the front end of the receptacle is to accommodate the plug of the removable module, and wherein the stepped lower surface of the receptacle is to engage the PCB; and a holder that is axially slidable over a longitudinal axis of the receptacle to constrain the elastic members of the receptacle to maintain contact with the holes in the plug of the removable module, wherein the holder comprises a plurality of tabs to limit movement of the holder with respect to the receptacle, wherein the holder surrounds four sides of the receptacle, wherein the holder comprises a hollow opening through an entire width of the holder to accommodate the receptacle, wherein the holder comprises a body portion completely surrounding the hollow opening, and wherein the body portion comprises a top surface, a bottom surface, and a pair of side surfaces all without holes.

12. The system of claim 11, wherein the plurality of tabs comprises a pair of tabs snap into grooves along sides of the receptacle to restrict the movement of the holder so that the tabs remain within the grooves, and an elongated tab extending away from the receptacle and having a length extending past the back end of the receptacle to restrict a movement of the receptacle.

13. The system of claim 11, wherein the hollow opening is to allow the receptacle to slide through the hollow opening and along an axial direction of the hollow opening.

14. The system of claim 13, wherein the tabs extend away from the body portion opposite to the axial direction.

15. The system of claim 11, wherein the module and the receptacle are arranged to form a universal serial bus device.

16. A holder to secure a modular device to a receptacle, the holder comprising:

a hollow opening to allow the receptacle to slide through the hollow opening so that the holder is axially slidable over a longitudinal axis of the receptacle in an axial direction of the hollow opening, wherein the holder surrounds four sides of the receptacle, and wherein the receptacle comprises an upper surface, a stepped lower surface, a front end, and a back end, and elastic members formed on the upper surface and the stepped lower surface of the receptacle to make contact with holes in a plug of the modular device when the front end of the receptacle is to accommodate the plug of the modular device;

a body portion completely surrounding the hollowing opening, wherein the body portion comprises a top surface, a bottom surface, and a pair of side surfaces all without holes; and a plurality of tabs to limit movement of the holder with respect to the receptacle.

17. The holder of claim 16, wherein the holder is slidable over the receptacle to constrain the elastic members of the receptacle to maintain contact with the holes in the plug of the modular device.

18. The holder of claim 16, wherein when the holder is not disposed over the elastic members of the receptacle, the plug of the modular device is removable from the receptacle.

19. The holder of claim 16, wherein the plurality of tabs comprises a pair of tabs snap into grooves along sides of the receptacle to restrict the movement of the holder so that the tabs remain within the grooves, and an elongated tab extending away from the receptacle and having a length extending past the back end of the receptacle to restrict a movement of the receptacle.

20. The holder of claim 16, wherein the tabs extend away from the body portion opposite to the axial direction.

* * * * *